US005869441A

United States Patent [19]

Fair et al.

[11] Patent Number: 5,869,441

[45] Date of Patent: Feb. 9, 1999

[54] BAR COMPOSITIONS COMPRISING NOVEL CHELATING SURFACTANTS

[75] Inventors: Michael Fair, Hackensack; Mengtao He, Wayne, both of N.J.; Michael Massaro, Congers, N.Y.

[73] Assignee: Lever Brothers Company, Division of Conopco, Inc., New York, N.Y.

[21] Appl. No.: 869,397

[22] Filed: Jun. 5, 1997

[51] Int. Cl.[6] ..... C11D 17/00; C11D 3/26

[52] U.S. Cl. ..... 510/447; 510/141; 510/434; 510/447; 510/450; 510/480; 510/501

[58] Field of Search ..... 510/141, 434, 510/447, 450, 480, 501

[56] References Cited

U.S. PATENT DOCUMENTS

| | | | |
|---|---|---|---|
| 4,144,182 | 3/1979 | Bereuter . | |
| 4,769,169 | 9/1988 | Fishlock-Lomax | 252/106 |
| 4,931,215 | 6/1990 | Palicka | 252/546 |
| 4,946,136 | 8/1990 | Fishlock-Lomax . | |
| 5,156,761 | 10/1992 | Aaslyng et al. | 252/174.12 |
| 5,177,243 | 1/1993 | Parker . | |
| 5,191,081 | 3/1993 | Parker . | |
| 5,191,106 | 3/1993 | Parker . | |
| 5,250,728 | 10/1993 | Parker et al. . | |
| 5,284,972 | 2/1994 | Parker et al. . | |
| 5,340,492 | 8/1994 | Kacher et al. | 252/112 |
| 5,340,502 | 8/1994 | Palicka | 252/546 |
| 5,589,447 | 12/1996 | Palicka | 510/237 |

FOREIGN PATENT DOCUMENTS

| | | |
|---|---|---|
| 160 507 | 11/1985 | European Pat. Off. . |
| 162 600 | 11/1985 | European Pat. Off. . |
| 214 868 | 3/1987 | European Pat. Off. . |
| 543432 | 5/1993 | European Pat. Off. . |
| 92/05236 | 2/1992 | WIPO . |
| 94/11476 | 5/1994 | WIPO . |
| 95/01153 | 1/1995 | WIPO . |
| 95/11004 | 4/1995 | WIPO . |

OTHER PUBLICATIONS

Inform, vol. 6, 10 (Oct. 1995, J. Crudden & B. Parker.

*Primary Examiner*—Paul Lieberman
*Assistant Examiner*—John M. Petruncio
*Attorney, Agent, or Firm*—Ronald A. Koatz

[57] ABSTRACT

The invention relates to bar compositions comprising an alkali metal salt of hydrophobically modified ethylenediaminetriacetic acid.

3 Claims, No Drawings

BAR COMPOSITIONS COMPRISING NOVEL CHELATING SURFACTANTS

FIELD OF THE INVENTION

The present invention relates to personal wash beauty bar compositions, particularly compositions comprising (1) novel EDTA-derived chelating anionic surfactants, preferably in combination with other types of anionic surfactants; and (2) one or more amphoteric surfactants. The invention relates to the incorporation of the novel EDTA-derived chelating surfactants into specific bar skin cleansing formulation bases. Through careful balancing of the anionic, amphoteric and optional nonionic surfactants, and through specific handling of the novel chelating surfactants during processing, ultra formulation mildness to skin is achieved without sacrificing other desired user properties, such as rich and creamy lather.

BACKGROUND OF THE INVENTION

Hydrophobically modified ethylenediaminetriacetic acid (EDTA) chelating surfactants, salts thereof, and methods for making these compounds are taught, for example, in U.S. Pat. Nos. 5,177,243, 5,191,081 and 5,191,106 (all assigned to Hampshire Chemical Corp.)

U.S. Pat. No. 5,250,728 to B. A. Parker et al., (assigned to Hampshire Chemical Corp.), teaches a novel route of synthesizing the hydrophobically modified ethylenediaminetriacetic acid.

U.S. Pat. No. 5,284,972 to B. A. Parker et al. (assigned to Hampshire Chemical Corp.) teaches a synthetic route leading to the salts of the hydrophobically modified ethylenediaminetriacetic acid which are the novel chelating surfactants applied by the subject invention.

Inform, Vol. 6, No. 10 (October, 1995, J. Crudden and B. Parker) teaches the physical and physiological properties of the novel chelating surfactants. Mild skin cleansers and mild shampoos are among the potential applications, as discussed in the articles.

Although these novel EDTA-derived surfactants are ultra-mild to skin, inclusion of the surfactants into a personal washing bar is fraught with difficulties. For example, the lather produced by the chelating surfactant alone is not as satisfactory as that of a conventional anionic detergent (e.g., sodium lauryl ether sulfate). Further, aqueous solutions of the EDTA surfactants at the concentrations relevant to the personal washing have a viscosity which is too low to deliver the desired sensory cues.

By this invention, applicants have formulated these chelating surfactants into specific skin cleansing formulations using specific routes of processing such that lather performance and other desired user properties are not sacrificed.

BRIEF SUMMARY OF THE INVENTION

The present invention comprises personal wash bar compositions comprising:

(1) 1 to 40% by wt. total composition salt or salts of hydrophobically modified ethylenediaminetriacetic acid

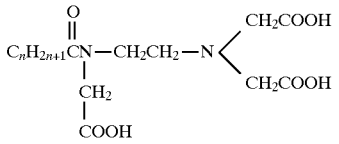

(2) 1 to 40% by wt. total composition one or more synthetic (non-soap) anionic surfactants other than the EDTA derived anionics described in (1) (for lather enhancement);

(3) 1 to 20% by wt. total composition one or more amphoteric and/or zwitterionic surfactants (to reduce skin irritation and enhance lather)

(4) 0 to 10% by wt. total composition one or more nonionic surfactants;

(5) 20 to 85% by wt. total composition of a structurant selected from the group consisting of alkylene oxide components having a molecular weight of from about 2,000 to about 25,000; $C_8$ to $C_{22}$ free fatty acids; $C_2$ to $C_{20}$ alkanols; paraffin waxes; and water soluble starches;

(6) 0 to 20% by wt. total composition of fatty acid soaps;

wherein no more than 1% of composition comprises inorganic salts with multivalent counterions (e.g., aluminum chloride).

The addition of 1 to 40% by wt. total composition of the novel EDTA-derived surfactants will lead to significantly enhanced mildness in such compositions without sacrificing the surfactancy of the EDTA-derived surfactants.

In a second embodiment, the application relates to a process for making a composition comprising:

(1) 1 to 40% by wt. total composition salt or salts of hydrophobically modified ethylenediaminetriacetic acid

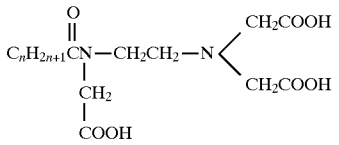

(2) 1 to 40% by wt. total composition one or more synthetic (non-soap) anionic surfactants other than the EDTA derived anionics described in (1) (for lather enhancement);

(3) 1 to 20% by wt. total composition one or more amphoteric and/or zwitterionic surfactants (to reduce skin irritation and enhance lather)

(4) 0 to 10% by wt. total composition one or more nonionic surfactants;

(5) 20 to 85% by wt. total composition of a structurant selected from the group consisting of alkylene oxide components having a molecular weight of from about 2,000 to about 25,000; $C_8$ to $C_{22}$ free fatty acids; $C_2$ to $C_{20}$ alkanols; paraffin waxes; and water soluble starches;

(6) 0 to 20% by wt. total composition of fatty acid soaps;

wherein no more than 1% of composition comprises inorganic salts with multivalent counterions (e.g., aluminum chloride);

wherein said process comprises:

(1) dispersing an acid form of EDTA into the structurant (s) at a temperature between about 80° to 120° C.;

(2) adding sufficient caustic (e.g., NaOH) to neutralize the EDTA acid surfactant (molar ratio of caustic to EDTA acid from about 1:1 to 1:3); and (3) mixing the EDTA/structurant solution with remaining compounds at temperature of 80° to 120° C.

DETAILED DESCRIPTION OF THE INVENTION

In one embodiment, the present invention relates to novel personal washing bar compositions, particularly compositions in which the surfactant system comprises 1 to 40% wt. total composition of the salt or salts of hydrophobically modified ethylenediaminetriacetic acid, and additionally comprises one or more anionic surfactants and one or more amphoteric surfactants, wherein no more than 1% of said compositions comprise salts with multivalent counterions (high levels are associated with lather depression). Using precise formulation windows, it is possible to incorporate EDTA-derived surfactants into bar compositions retaining the benefits of mildness and without sacrificing latherability.

In a second embodiment, the invention relates to a process for forming such bar compositions while retaining mildness and lathering, and acceptable bar properties by ensuring that EDTA acid is first dispersed into structurant and subsequently adding sufficient caustic to neutralize the EDTA acid.

The compositions and processing are defined in greater detail below:

In the first embodiment of the invention, the personal wash bar compositions comprise:

(1) 1 to 40% by wt. total composition salt or salts of hydrophobically modified ethylenediaminetriacetic acid;

the hydrophobically modified ethylenediaminetriacetic acids have general structure as follows:

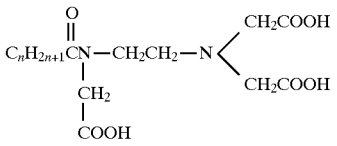

where n is from 1 to 40.

If unsaturation occurs, the hydrophobically modified group may be $C_nH_{2n-1}$ where n is 2 to 40 and if further unsaturation occurs, the group may be $C_nH_{2n-3}$ where n is 3 to 40 and so forth. The salts are the salts of one or more of the carboxylic acid groups. These compounds and methods of their preparation are described, for example, in U.S. Pat. No. 5,284,972 to Parker et al., hereby incorporated by reference into the subject application;

(2) 1 % to 40% by wt. total composition one or more anionic surfactants other than the hydrophobically modified EDTA-derived compounds described above;

inclusion of the such anionic surfactants (i.e., lathering surfactants) is preferred because the EDTA-derived surfactants alone do not deliver satisfactory lather performance;

(3) 1 to 20% by wt. total composition one or more amphoteric and/or zwitterionic surfactants; inclusion of the amphoteric and zwitterionic surfactants is a criticality and required because the amphoteric surfactants reduce the skin irritation potential of the anionic surfactants in (2) and enhance the lather performance; and (4) 0 to 10% by wt. total composition one or more nonionic surfactants.

Finally the formulations of the invention preferably comprise no more than 1% wt. total composition of inorganic and organic salts of Calcium ($Ca^{2+}$), Magnesium ($Mg^{2+}$), Aluminum ($Al^{3+}$) and other multivalent metal counterions, and mixtures thereof; preferably said salts are excluded from the total composition; the restriction on the concentration of said salts is important because such salts tend to diminish the lather performance of the EDTA-derived surfactants.

Examples of the multi-valence salts include, but are not limited to, Calcium Chloride, Magnesium Chloride, Aluminum Chloride, Magnesium sulfate, Magnesium Stearate, Calcium Laurate, etc.

By using these specific formulation ingredients in specific formulation windows (e.g., 1% to 40% EDTA-derived surfactants), it is possible to make a composition comprising the mild surfactants without sacrificing lathering ability. To further insure this, the formulations should be made using the process encompassed by the second embodiment of the invention described in more detail below.

The various formulation components are described in greater detail below:

The EDTA-Derived Anionic Suffactants (Component (1))

The salt and/or salts of the hydrophobically modified ethylenediaminetriacetic acid (EDTA) are salts(s) of the N-acyl EDTA surfactants described in U.S. Pat. Nos. 5,177,243, 5,191,081, 5,191,106, 5,250,728, and 5,284,972, all of which are incorporated by reference into the subject application. The synthesis, physical and physiological properties of the EDTA-derived surfactants are also summarized in an article published recently (Inform, Vol. 6 no.10, October 1995).

The hydrophobically modified ethylenediaminetriactive acids have general structure as follows:

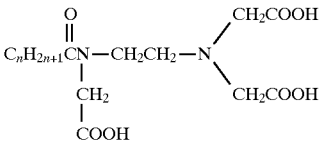

where n is from 1 to 40.

If unsaturation occurs, the hydrophobically modified group may be $C_nH_{2n-1}$ where n is 2 to 40 and if further unsaturation occurs, the group may be $C_nH_{2n-3}$ where n is 3 to 40 and so forth. The salts are the salts of one or more of the carboxylic acid groups. These compounds and methods of their preparation are described, for example, in U.S. Pat. No, 5,284,972 to Parker et al., hereby incorporated by reference into the subject application.

The counterions which may be used for the EDTA derived surfactants of the subject invention include but are not limit to Sodium ($Na^+$), Potassium ($K^+$), ammonium ($NH_4^+$), monoethanolamine, diethanolamine, triethanolamine, N-Propylamine, isopropylamine, and tris(hydroxymethyl aminomethane). As noted, multivalent counterions should be avoided.

Examples of the N-acyl EDTA surfactants used by the current invention include, under the names given by B. Parker et al. (Inform, Vol. 6 no. 10, October 1995), sodium lauroyl ED3A, Potassium cocoyl ED3A, triethanolamine myristoyl ED3A, and sodium Oleoyl ED3A.

The EDTA-derived surfactants comprise 1% to 40% of the total composition. In addition, the surfactant should comprise at least 5%, preferably 8%, more preferably ≧10% of the total anionic surfactants in the composition.

Other Anionic Surfactants (Component (2))

The anionic surfactant other than EDTA-derived surfactant may be, for example, an aliphatic sulfonate, such as a primary alkane (e.g., $C_8$–$C_{22}$) sulfonate, primary alkane (e.g., $C_8$–$C_{22}$) disulfonate, $C_8$–$C_{22}$ alkene sulfonate, $C_8$–$C_{22}$ hydroxyalkane sulfonate or alkyl glyceryl ether sulfonate (AGS); or an aromatic sulfonate such as alkyl benzene sulfonate.

The anionic may also be an alkyl sulfate (e.g., $C_{12}$–$C_{18}$ alkyl sulfate) or alkyl ether sulfate (including alkyl glyceryl ether sulfates). Among the alkyl ether sulfates are those having the formula:

$$RO(CH_2CH_2O)_nSO_3M$$

wherein R is an alkyl or alkenyl having 8 to 18 carbons, preferably 12 to 18 carbons, n has an average value of greater than 1.0, preferably between 2 and 3; and M is a solubilizing cation such as sodium, potassium, ammonium or substituted ammonium. Ammonium and sodium lauryl ether sulfates are preferred.

The anionic may also be alkyl sulfosuccinates (including mono- and dialkyl, e.g., $C_6$–$C_{22}$ sulfosuccinates); alkyl and acyl taurates, alkyl and acyl sarcosinates, sulfoacetates, $C_8$–$C_{22}$ alkyl phosphates and phosphates, alkyl phosphate esters and alkoxyl alkyl phosphate esters, acyl lactates, $C_8$–$C_{22}$ monoalkyl succinates and maleates, sulphoacetates, and acyl isethionates.

Sulfosuccinates may be monoalkyl sulfosuccinates having the formula:

$$R^4O_2CCH_2CH(SO_3M)CO_2M;$$

amido-MEA sulfosuccinates of the formula $$R^4CONHCH_2CH_2O_2CCH_2CH(SO_3M)CO_2M$$

wherein $R^4$ ranges from $C_8$–$C_{22}$ alkyl and M is a solubilizing cation;

amido-MIPA sulfosuccinates of formula $$RCONH(CH_2)CH(CH_3)(SO_3M)CO_2M$$

where M is as defined above.

Also included are the alkoxylated citrate sulfosuccinates; and alkoxylated sulfosuccinates such as the following:

$$R-O-(CH_2CH_2O)_nC(=O)CH_2CH(SO_3M)CO_2M$$

wherein n=1 to 20; and M is as defined above.

Sarcosinates are generally indicated by the formula $$RCON(CH_3)CH_2CO_2M,$$

wherein R ranges from $C_8$–$C_{20}$ alkyl and M is a solubilizing cation.

Taurates are generally identified by formula $$R^2CONR^3CH_2CH_2SO_3M$$

wherein $R^2$ ranges from $C_8$–$C_{20}$ alkyl, $R^3$ ranges from $C_1$–$C_4$ alkyl and M is a solubilizing cation.

Another class of anionics are carboxylates such as follows:

$$R-(CH_2CH_2O)_nCO_2M$$

wherein R is $C_8$ to $C_{20}$ alkyl; n is 0 to 20; and M is as defined above.

Another carboxylate which can be used is amido alkyl polypeptide carboxylates such as, for example, Monteine LCQ® by Seppic.

Another surfactant which may be used are the $C_8$–$C_{18}$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

Acyl isethionates, when present, will generally range from about 0.5–15% by weight of the total composition. Preferably, this component is present from about 1 to about 10%.

The acyl isethionate may be an alkoxylated isethionate such as is described in liardi et al., U.S. Pat. No. 5,393,466, hereby incorporated by reference into the subject application. This compound has the general formula:

$$RC(=O)-O-CH(X)-CH_2-(OCH(Y)-Ch_2)_m-SO_3M^+$$

wherein R is an alkyl group having 8 to 18 carbons, m is an integer from 1 to 4, X and Y are hydrogen or an alkyl group having 1 to 4 carbons and $M^+$ is a monovalent cation such as, for example, sodium, potassium or ammonium.

In general the anionic component will comprise from about 1 to 40% by weight of the composition, preferably 5 to 30%, most preferably 8 to 25% by weight of the composition.

Zwitterionic and Amphoteric Surfactants (Component (3))

Zwitterionic surfactants are exemplified by those which can be broadly described as derivatives of aliphatic quaternary ammonium, phosphonium, and sulfonium compounds, in which the aliphatic radicals can be straight or branched chain, and wherein one of the aliphatic substituents contains from about 8 to about 18 carbon atoms and one contains an anionic group, e.g., carboxy, sulfonate, sulfate, phosphate, or phosphonate. A general formula for these compounds is:

$$R^2-Y^{(+)}(R^3)_x-CH_2-R^4Z^{(-)}$$

wherein $R^2$ contains an alkyl, alkenyl, or hydroxy alkyl radical of from about 8 to about 18 carbon atoms, from 0 to about 10 ethylene oxide moieties and from 0 to about 1 glyceryl moiety; Y is selected from the group consisting of nitrogen, phosphorus, and sulfur atoms; $R^3$ is an alkyl or monohydroxyalkyl group containing about 1 to about 3 carbon atoms; X is 1 when Y is a sulfur atom, and 2 when Y is a nitrogen or phosphorus atom; $R^4$ is an alkylene or hydroxyalkylene of from about 1 to about 4 carbon atoms and Z is a radical selected from the group consisting of carboxylate, sulfonate, sulfate, phosphonate, and phosphate groups.

Examples of such surfactants include:

4-[N,N-di(2-hydroxyethyl)-N-octadecylammonio]-butane-1-carboxylate;

5-[S-3-hydroxypropyl-S-hexadecylsulfonio]-3-hydroxypentane-1-sulfate;

3-[P,P-diethyl-P-3,6,9-trioxatetradexocylphosphonio]-2-hydroxypropane-1-phosphate;

3-[N,N-dipropyl-N-3-dodecoxy-2-hydroxypropylammonio]-propane-1-phosphonate;

3-(N,N-dimethyl-N-hexadecylammonio)propane-1-sulfonate;

3-(N,N-dimethyl-N-hexadecylammonio)-2-hydroxypropane-1-sulfonate;

4-[N, N-di(2-hydroxyethyl)-N-(2-hydroxydodecyl) ammonio]-butane-1-carboxylate;

3-[S-ethyl-S-(3-dodecoxy-2-hydroxypropyl)sulfonio]-propane-1-phosphate;

3-[P,P-dimethyl-P-dodecylphosphonio]-propane-1-phosphonate; and

5-[N,N-di(3-hydroxypropyl)-N-hexadecylammonio]-2-hydroxy-pentane-1-sulfate.

Amphoteric detergents which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula:

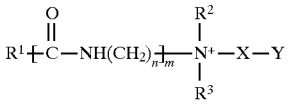

where $R^1$ is alkyl or alkenyl of 7 to 18 carbon atoms;

$R^2$ and $R^3$ are each independently alkyl, hydroxyalkyl or carboxyalkyl of 1 to 3 carbon atoms;

n is 2 to 4;

m is 0 to 1;

X is alkylene of 1 to 3 carbon atoms optionally substituted with hydroxyl, and

Y is $—CO_2—$ or $—SO_3—$

Suitable amphoteric detergents within the above general formula include simple betaines of formula:

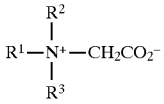

and amido betaines of formula:

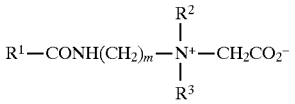

where m is 2 or 3.

In both formulae $R^1$, $R^2$ and $R^3$ are as defined previously. $R^1$ may in particular be a mixture of $C_{12}$ and $C_{14}$ alkyl groups derived from coconut so that at least half, preferably at least three quarters of the groups $R^1$ have 10 to 14 carbon atoms. $R^2$ and $R^3$ are preferably methyl.

A further possibility is that the amphoteric detergent is a sulphobetaine of formula

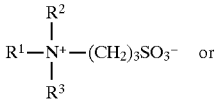

-continued

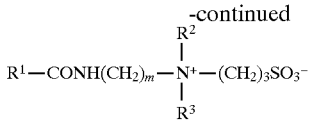

where m is 2 or 3, or variants of these in which $—(CH_2)_3SO^-_3$ is replaced by

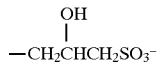

In these formulae $R^1$, $R^2$ and $R^3$ are as discussed previously.

A further possibility is that the amphoteric detergent is a sulphobetaine of formula

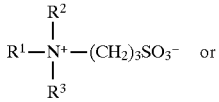

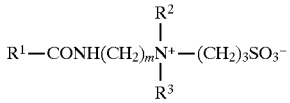

where m is 2 or 3, or variants of these in which $—(CH_2)_3SO_3^-$ is replaced by

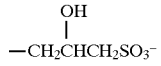

In these formulae $R^1$, $R^2$ and $R^3$ are as discussed previously.

Amphoacetates and diamphoacetates are also intended to be covered in possible zwitterionic and/or amphoteric compounds which may be used.

The amphoteric/zwitterionic generally comprises 0.1 to 20% by weight, preferably 0.5% to 15%, more preferably 1.0 to 10% by wt. of the composition.

Optional Nonionic Surfactants (Component (4))

In addition to one or more anionic and amphoteric and/or zwitterionic, the surfactant system may optionally comprise a nonionic surfactant.

The nonionic which may be used includes in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The nonionic may also be a sugar amide, such as a polysaccharide amide. Specifically, the surfactant may be one of the lactobionamides described in U.S. Pat. No. 5,389,279 to Au et al. which is hereby incorporated by reference or it may be one of the sugar amides described in U.S. Pat. No. 5,009,814 to Kelkenberg, hereby incorporated into the subject application by reference.

Other surfactants which may be used are described in U.S. Pat. No. 3,723,325 to Parran Jr. and alkyl polysaccharide nonionic surfactants as disclosed in U.S. Pat. No. 4,565,647 to Lienado, both of which are also incorporated into the subject application by reference.

Preferred alkyl polysaccharides are alkylpolyglycosides of the formula $$R^2O(C_nH_{2n}O)_t(\text{glycosyl})_x$$

wherein R is selected from the group consisting of alkyl, alkylphenyl, hydroxyalkyl, hydroxyalkylphenyl, and mixtures thereof in which alkyl groups contain from about 10 to about 18, preferably from about 12 to about 14, carbon atoms; n is 0 to 3, preferably 2; t is from 0 to about 10, preferably 0; and x is from 1.3 to about 10, preferably from 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

The nonionic surfactant can also be a water soluble polymer chemically modified with hydrophobic moiety or moieties. For example, EO-PO block copolymer, hydrophobically modified PEG such as POE(200)-glyceryl-stearate can be included in the formulations claimed by the subject invention.

Nonionic comprises 0 to 10% by wt. of the composition.

Other Optional Ingredients

In addition, the compositions of the invention may include optional ingredients as follows:

Organic solvents, such as ethanol; auxiliary thickeners, such as carboxymethylcellulose, magnesium aluminum silicate, hydroxyethylcellulose, methylcellulose, carbopols, glucamides, or Antil® from Rhone Poulenc; perfumes; sequestering agents, such as tetrasodium ethylenediaminetetraacetate (EDTA), EHDP or mixtures in an amount of 0.01 to 1%, preferably 0.01 to 0.05%; and coloring agents, opacifiers and pearlizers such as zinc stearate, magnesium stearate, $TiO_2$, EGMS (ethylene glycol monostearate) or Lytron 621 (StyrenelAcrylate copolymer); all of which are useful in enhancing the appearance or cosmetic properties of the product.

The compositions may further comprise antimicrobials such as 2-hydroxy-4,2'4' trichlorodiphenylether (DP300); preservatives such as dimethyloldimethylhydantoin (Glydant XL1000), parabens, sorbic acid etc.

The compositions may also comprise coconut acyl mono- or diethanol amides as suds boosters, and strongly ionizing salts such as sodium chloride and sodium sulfate may also be used to advantage.

Antioxidants such as, for example, butylated hydroxytoluene (BHT) may be used advantageously in amounts of about 0.01% or higher if appropriate.

Cationic conditioners which may be used include Quatrisoft LM-200 Polyquaternium-24, Merquat®-polymer; and Jaguar® type conditioners from Rhone-Poulenc; and Salcare®-type conditioners from Allied Colloids.

Polyethylene glycols which may be used include:

| | | |
|---|---|---|
| Polyox | WSR-205 | PEG 14M, |
| Polyox | WSR-N-60K | PEG 45M, or |
| Polyox | WSR-N-750 | PEG 7M. |

PEG with molecular weight ranging from 300 to 10,000 Dalton, such as those marketed under the tradename of CARBOWAX SENTRY® by Union Carbide.

Another ingredient which may be included are exfoliants such as polyoxyethylene beads, walnut shells and apricot seeds The structurant of the invention can be a water soluble or water insoluble structurant.

Water soluble structurants include moderately high molecular weight polyalkylene oxides of appropriate melting point (e.g., 40° to 100° C., preferably 50° to 90° C.) and in particular polyethylene glycols or mixtures thereof.

Polyethylene glycols (PEG's) which are used may have a molecular weight in the range 2,000 to 25,000, preferably 3,000 to 10,000. However, in some embodiments of this invention it is preferred to include a fairly small quantity of polyethylene glycol with a molecular weight in the range from 50,000 to 500,000, especially molecular weights of around 100,000. Such polyethylene glycols have been found to improve the wear rate of the bars. It is believed that this is because their long polymer chains remain entangled even when the bar composition is wetted during use.

If such high molecular weight polyethylene glycols (or any other water soluble high molecular weight polyalkylene oxides) are used, the quantity is preferably from 1% to 5%, more preferably from 1% to 1.5% to 4% or 4.5% by weight of the composition. These materials will generally be used jointly with a large quantity of other water soluble structurant such as the above mentioned polyethylene glycol of molecular weight 2,000 to 25,000, preferably 3,000 to 10,000.

Water insoluble structurants also have a melting point in the range 40°–100° C., more preferably at least 50° C., notably 50° C. to 90° C. Suitable materials which are particularly envisaged are fatty acids, particularly those having a carbon chain of 12 to 24 carbon atoms. Examples are lauric, myristic, palmitic, stark, arachidic and behenic acids and mixtures thereof. Sources of these fatty acids are coconut, topped coconut, palm, palm kernel, babassu and tallow fatty acids and partially or fully hardened fatty acids or distilled fatty acids. Other suitable water insoluble structurants include alkanols of 8 to 20 carbon atoms, particularly cetyl alcohol. These materials generally have a water solubility of less than 5 g/liter at 20° C.

Soaps (e.g., sodium stearate) can also be used at levels of about 1% to 15%. the soaps may be added neat or made in situ by adding a base, e.g., NaOH, to convert free fatty acids.

The relative proportions of the water soluble structurants and water insoluble structurants govern the rate at which the bar wears during use. The presence of the water-insoluble structurant tends to delay dissolution of the bar when exposed to water during use and hence retard the rate of wear.

Another optional ingredient is oil/emollient which may be added as a benefit agent to the bars compositions.

Various classes of oils are set forth below.

Vegetable oils: Arachis oil, castor oil, cocoa butter, coconut oil, corn oil, cotton seed oil, olive oil, palm kernel oil, rapeseed oil, safflower seed oil, sesame seed oil and soybean oil.

Esters: Butyl myristate, cetyl palmitate, decyloleate, glyceryl laurate, glyceryl ricinoleate, glyceryl stearate, glyceryl isostearate, hexyl laurate, isobutyl palmitate, isocetyl stearate, isopropyl isostearate, isopropyl laurate, isopropyl linoleate, isopropyl, myristate, isopropyl palmitate, isopropyl stearate, propylene glycol monolaurate, propylene glycol ricinoleate, propylene glycol stearate, and propylene glycol isostearate.

Animal Fats: Acytylated lanolin alcohols, lanolin, lard, mink oil and tallow.

Fatty acids and alcohols: Behenic acid, palmitic acid, stearic acid, behenyl alcohol, cetyl alcohol, eicosanyl alcohol and isocetyl alcohol.

Other examples of oil/emollients include mineral oil, petrolatum, silicone oil such as dimethyl polysiloxane, lauryl and myristyl lactate.

The emollient/oil is generally used in an amount from about 1 to 20%, preferably 1 to 15% by wt. of the composition. Generally, it should comprise no more than 20% of the composition.

Preferably, the compositions of the invention should comprise no more than 1%, and should more preferably be free of inorganic or organic salts of multivalent metal counterions. Such metal counterions are defined as having valence of +2 or higher and include counterions such as calcium, magnesium and aluminum. Examples of such salts include, for example, aluminum chloride, magnesium chloride, calcium chloride and magnesium laurels. While not wishing to be bound by theory, it is believed essential to keep the amount of such counterions low or absent so that they don't interfere with lather performance of EDTA-derived anionic surfactant.

In a second embodiment of the invention, the invention relates to a process of making the composition of the invention to ensure that EDTA-derived surfactant is incorporated, provides desired mildness characteristics and that latherability is not at the same time compromised.

More specifically, process comprises:

(a) dispersing an acid form of EDTA into molten structurant system at temperature between 80° C. and 120° C.; and (b) adding sufficient caustic to neutralize the EDTA surfactant.

This in situ neutralization process is necessary to avoid gelling of the EDTA derived surfactant. The gelling, which occurs in an aqueous solution, prevents a homogeneous mixing of the ingredients.

The following examples are intended to illustrate further the invention and are not intended to limit the invention in any way.

All percentages are intended to be percentages by weight unless stated otherwise.

EXAMPLES

Protocol of Skin Mildness Evaluation

Mildness Assessments: Zein dissolution test was used to preliminary screen the irritation potention of the formulations studied. In an 8 oz. jar, 30 mLs of an aqueous dispersion of a formulation were prepared. The dispersions sat in a 45° C. bath until fully dissolved. Upon equilibration at room temperature, 1.5 gms of zein powder were added to each solution with rapid stirring for one hour. The solutions were then transferred to centrifuge tubes and centrifuged for 30 minutes at approximately 3,000 rpms. The undissolved zein was isolated, rinsed and allowed to dry in 60° C. vacuum oven to a constant weight. The percent zein solubilized, which is proportional to irritation potential, was determined gravimetrically.

The Lather Volume Measurement: The lather performance was studied by a cylinder shaking test. Forty grams of a test solution was put in a 250 ml PYREX cylinder with cap. Foam was generated by shaking the cylinder for 0.5 minute. After the foam settled for 2.5 minutes, the foam height was measured.

Example 1

An In-Vitro Test of the Skin Mildness of Na-LED3A

The skin irritation potential of Na-LED3A was investigated by the zein dissolution test. As shown in Table 1, Na-LED3A dissolved significantly less amount of zein than commonly used anionic surfactants, such as sodium cocoyl isethionate and sodium lauryl ether (3EO) sulfate. The result indicates that the sodium lauroyl EDTA is an ultra-mild anionic surfactant to skin.

TABLE 1

Zein Dissolution Test

| Surfactant | % Zein Dissolved |
|---|---|
| 1% Na Cocoyl Isethionate | 34 |
| 1% Na Lauryl Ether (3EO) Sulfate | 41 |
| 1% Na LED3A | 8 |

When Na LED3A is incorporated in typical bar formulations (Example 5), the percent zein dissolved is also significantly reduced as shown below in Table 2.

TABLE 2

Zein Dissolution Test

| Composition | % Zein Dissolved |
|---|---|
| Comparative Formulation A (no Na-LED3A | 15.3 |
| Formulation B | 7.3 |
| Formulation C | 6.2 |

Example 2

Formulation Processing

The Preparation of the EDTA Derived Surfactants: Sodium lauroyl EDTA (named as Na-LED3A) was obtained through neutralizing N-lauroyl-N, N'N'-ethylenediaminetriacetic (Hampshire, under the trade name of LED3A) using 50% sodium hydroxide (NaOH) solution. LED3A was first dispersed and mixed in molten polyethylene glycol 8000 at a temperature between 80° C. and 120° C. A precalculated amount of sodium hydroxide solution (50%) was slowly added to neutralize the LED3A. After adequate mixing, the remaining ingredients were added. This in-situ process was used to avoid the gelling of EDTA-derived surfactants in an aqueous solution (gelling occurs at concentrations between 40% and 79% by weight in water) which prevents a homogeneous mixing of the bar material.

Formulation Processing: Formulations shown in the examples of this invention were prepared in 400 mL beakers in a 100° C. oil bath. Mixing was accomplished with a variable speed overhead motor. Batch size was varied from 100–250 gms. All chemicals used except the EDTA derived surfactants were commercial materials and used as supplied.

Example 3

The Lather of Na-LED3A

The lather performance of the Na-LED3A aqueous solution is not as satisfactory as those commonly used anionic surfactants, such as sodium lauryl ether (3EO) sulfate. As shown in Table 3, the lather volume of the 2.5% Na-LED3A is significantly less than that of SLES. However, by adding relatively low levels of SLES and Cocoamidopropyl betaine as coactives to the Na-LED3A solution, the lather performance was greatly improved. This example demonstrates the necessity of inclusion of anionic and amphoteric surfactants into an EDTA-derived surfactant based skin cleanser.

TABLE 3

Lather Volume of Surfactant Aqueous Solutions

| Compositions | Lather Volume (ml) |
|---|---|
| 2.5% wt. Na-LED3A* | 124 |
| 2.5% wt. Sodium Lauryl Ether (3EO) Sulfate | 170 |
| 2.5% wt. Na-LED3A, | 211 |
| 1.0% wt. Sodium Lauryl Ether (3EO) Sulfate | |
| 0.5% wt. Cocoamidopropyl Betaine | |

*An EDTA-derived anionic surfactant defined in Example 1.

Table 4 shows the lather volumes of bar formulations which are composed of Na-LED3A. This example demonstrates that acceptable lather performance is achieved when the chelating surfactant is incorporated in bar formulations.

TABLE 4

Lather Volume of Formulations in Example 5

| Compositions | Lather Volume (ml) |
|---|---|
| Formulation A | >250 |
| Formulation B | >250 |
| Formulation C | >250 |

Example 4

The Defoaming Effect of Multi-Valence Salts to the EDTA-Derived Surfactants

Organic and inorganic salts containing multi-valence salts, such as Aluminum Chloride, Magnesium Chloride, Calcium Chloride, Calcium stearate, Magnesium laurate, etc. are often used in personal washing products. However, these multi-valence salts can interact with the EDTA-derived surfactants and cause defoaming if the salt concentration is above 1% wt. total composition. As shown in Table 2, 2.5% salts significantly defoamed the EDTA-derived surfactant. Therefore, preferably, these multi-valence salts are excluded from the skin cleansing compositions claimed by this invention.

TABLE 2

Lather Volume of the Surfactant Solutions w/ and w/o the Multi-Valence Salts

| Compositions | Lather Volume (ml) |
|---|---|
| 2.5% wt. Na-LED3A* | 124 |
| 2.5% wt. Na-LED3A | 39 |
| 2.5% wt. Aluminum Chloride | |
| 2.5% wt. Na-LED3A | 2 |
| 2.5% wt. Magnesium Chloride | |

*An EDTA-derived anionic surfactant defined in Example 1.

Example 5

Skin Cleansing Composition

All amounts are given in percentage of weight. Formulations (A), (B) and (C) used sodium cocoyl isethionate and Na-LED3A as the major anionic detergent with amphoteric cocoamidopropyl betaine as a coactive. The formulations provide rich, creamy, and slippery lather that was rinsed off easily.

TABLE 3

| Formulation | (A) | (B) | (C) |
|---|---|---|---|
| Sodium cocoyl isethionate (From DEFI*) | 27.0 | 13.5 | 7.0 |
| Polyethylene glycol 8000 | 32.0 | 32.0 | 32.0 |
| Cocoamidopropyl betaine | 5.0 | 5.0 | 5.0 |
| Palmitic-stearate acid (From IGEPON or DEFI) | 16.5 | 16.5 | 16.5 |
| Sodium stearate | 5.0 | 5.0 | 5.0 |
| Maltodextrin | 6.0 | 6.0 | 6.0 |
| Na-LED3A** | 0 | 13.5 | 20.0 |
| Sodium isethionate | 2.2 | 2.2 | 2.2 |
| Coconut acid | 1.1 | 1.1 | 1.1 |
| Water | 5.0 | 5.0 | 5.0 |

*DEFI: directly esterified fatty acid isethionate, which is a mixture containing about 74% by weight of sodium acyl isethionate, 23% stearic-palmitic acid and small amounts of other materials, manufactured by Lever Brother Co., U.S.

*Na-LED3A: an EDTA-derived surfactant defined by Example 1.

We claim:

1. A bar detergent composition comprising:

(a) 1 to 40% by wt. total composition of an alkali metal salt of hydrophobically modified ethylenediaminetriacetic acid, said hydrophobic ally modified ethylenediaminetriacetic acid salt having a structure as set forth below:

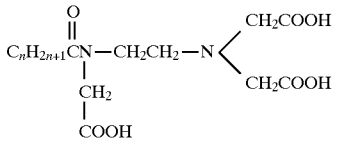

wherein n is from 1 to 40;

(b) 1 to 40% by wt. total composition of one or more synthetic non-soap, anionic surfactants other than the ethylenediaminetriacetic derived anionics described in (a);

(c) 1 to 20% by wt. total composition one or more amphoteric surfactant, zwitterionic surfactant or mixture thereof;

(d) 0 to 10% by wt. nonionic surfactant;

(e) 20 to 85% by wt. total composition of a structurant selected from the group consisting of alkylene oxide components having a molecular weight of from about 2,000 to about 25,000; $C_8$ to $C_{22}$ free fatty acids; $C_2$ to $C_{20}$ alkanols; paraffin waxes; and water soluble starches; and (f) 0 to 20% by wt. total composition fatty acid soap;

wherein no more than 1% by wt. total composition comprises an inorganic or organic salt selected from the group consisting of calcium, magnesium, aluminum, other multi-valence metal counterions, and mixtures thereof.

2. A composition according to claim 1(*a*), wherein the salt of hydrophobically modified ethylenediaminetriacetic acid is equal to or greater than 50% by wt. of the total anionic surfactant system.

3. A composition according to claim 1, wherein the multi-valence salt is selected from the group consisting of calcium chloride, magnesium chloride, aluminum chloride, magnesium sulfate, magnesium stearate and calcium laurate.

* * * * *